US008157461B2

(12) United States Patent
Ishida et al.

(10) Patent No.: US 8,157,461 B2
(45) Date of Patent: Apr. 17, 2012

(54) PRINTER

(75) Inventors: Tetsugo Ishida, Shiojiro (JP); Masahiko Yamada, Omi-mura (JP); Rikuo Yamada, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 722 days.

(21) Appl. No.: 12/313,386

(22) Filed: Nov. 20, 2008

(65) Prior Publication Data

US 2009/0129846 A1 May 21, 2009

(30) Foreign Application Priority Data

Nov. 20, 2007 (JP) ..... 2007-300203

(51) Int. Cl.
*B41J 29/02* (2006.01)

(52) U.S. Cl. ..... 400/691; 400/613; 400/663; 400/55

(58) Field of Classification Search ..... 400/578–719
See application file for complete search history.

(56) References Cited

U.S. PATENT DOCUMENTS

| | | | | |
|---|---|---|---|---|
| 4,330,219 | A * | 5/1982 | Miyasaka et al. | 400/690.4 |
| 6,155,730 | A * | 12/2000 | Nakayama et al. | 400/613 |
| 6,474,883 | B1 * | 11/2002 | Kawakami et al. | 400/613 |
| 6,485,210 | B2 * | 11/2002 | Choi | 400/691 |
| 6,789,969 | B2 * | 9/2004 | Hirabayashi et al. | 400/693 |
| 6,997,623 | B2 * | 2/2006 | Nebashi | 400/55 |
| 7,914,218 | B2 * | 3/2011 | Sekino et al. | 400/693 |
| 2001/0016135 | A1 * | 8/2001 | Hosomi | 400/613 |
| 2008/0297584 | A1 * | 12/2008 | Lyons et al. | 347/211 |
| 2009/0255971 | A1 * | 10/2009 | Nakamaki et al. | 226/1 |

FOREIGN PATENT DOCUMENTS

| | | |
|---|---|---|
| EA | 0 990 533 A2 | 4/2000 |
| EP | 1 108 556 A1 | 6/2001 |
| EP | 1 749 623 A1 | 2/2007 |
| JP | 06-040055 | 2/1994 |
| JP | 2005-043659 | 2/2005 |
| JP | 2006-126224 | 5/2006 |

* cited by examiner

*Primary Examiner* — Seung Lee
*Assistant Examiner* — Christle Marshall
(74) *Attorney, Agent, or Firm* — Nutter McClennen & Fish LLP; John J. Penny, Jr.; Derek P. Roller

(57) ABSTRACT

A printer having one roller of a transportation roller pair attached to cover renders the mechanism pressing the transportation roller pair together and the damping mechanism used when opening the cover using few parts, compactly, and at low cost. A damper spring 27 prevents the cover unit 3 of the printer 1 from opening suddenly and forcefully. A roller support lever 38 having the first follower roller 33*b* disposed to the distal end thereof is attached rotatably and movably to the cover unit 3. The roller support lever 38 is urged by the damper spring 27, and the first follower roller 33*b* on the distal end thereof is pressed to the first transportation roller 33*a* on the printer frame 11 side. The damper spring 27 functions as the damping mechanism when the cover unit 3 opens, and as the pressure mechanism of the first transportation roller pair 33 when the cover unit 3 is closed.

7 Claims, 6 Drawing Sheets

PRINTER

BACKGROUND OF THE INVENTION

The entire disclosure of Japanese Patent Application No. 2007-300203 filed on Nov. 20, 2007, is expressly incorporated by reference herein.

1. Field of Invention

The present invention relates to a printer that has a cover that opens and closes to open and close a roll paper compartment or other part of the printer, and relates more particularly to a transportation roller pair for conveying roll paper or other print medium disposed therebetween, the transportation roller pair being disposed to the transportation path so that the rollers separate from each other when the cover opens.

2. Description of Related Art

Printers that print to roll paper or other type of continuous print medium, convey the paper by transportation roller pairs disposed to the transportation path, and have one roller in the transportation roller pair disposed to a cover that opens and closes so that the transportation path opens when the cover opens are known from the literature. Japanese Unexamined Patent Appl. Pub. JP-A-H06-40055, for example, teaches a thermal printer in which the transportation path opens when a cover is opened, enabling replacing the roll paper.

The rollers of the transportation roller pair are pressed together by a spring force so that the printing paper is held therebetween and can be conveyed with a predetermined transportation force. Therefore, when one roller in the transportation roller pair is disposed to an operable cover, a force (repulsion to the spring force of the transportation roller pair) urging the cover to open is always applied to the cover when the cover is closed. As a result, when the cover is unlocked and opened, the this force acting in the direction in which the cover opens may cause the cover to spring open quickly. Particularly in a printer on which the cover opens forward from an upright closed position to a horizontal open position, the weight of the cover combined with this spring force causes the cover to open with such force that it may forcefully impact the surface on which the printer is placed.

SUMMARY OF THE INVENTION

A printer having one roller in a transportation roller pair disposed to an operable cover according to at least one embodiment of the invention can press the transportation rollers together while also preventing the cover from opening suddenly.

A printer according to a first aspect of the invention has a cover attached to a printer chassis so that it can be opened and closed, a transportation roller pair that conveys printing paper, and a cover urging member that is attached between the cover and the printer chassis. The cover urging member urges the cover in the closing direction when the cover is opened, and urges the roller pair in a direction so as to be pushed together when the cover is closed.

The printer according to this first aspect of the invention uses the urging force of the cover urging member that urges the cover in the closing direction so that the cover does not open quickly and forcefully to also produce the force pressing the transportation roller pair together. A mechanism for dampening movement of the cover and preventing the cover from opening forcefully, and a mechanism for applying pressure to the transportation roller pair, can thus be rendered using the same cover urging member. The construction is thus simplified, the parts count can be reduced, and the size and cost can be reduced.

Preferably, when the transportation roller pair includes a chassis-side roller that is attached to the printer chassis and a cover-side roller that is attached to the cover, the cover-side roller is arranged to separate from the chassis-side roller when the cover is opened, and the cover urging member is arranged to press the cover-side roller to the chassis-side roller when the cover is closed.

When the cover is open in this aspect of the invention, the urging force of the cover urging member works in the direction closing the cover, and the cover-side roller moves in the direction away from the chassis-side roller. When the cover is closed, the cover-side roller contacts the chassis-side roller, and the urging force of the cover urging member then works as a force pushing the cover-side roller to the chassis-side roller.

Therefore, when the cover is closed the urging force of the cover urging member working on the cover changes to a force pressing the cover-side roller to the chassis-side roller. When the cover opens, the path for conveying the printing paper rendered by the cover-side roller and the chassis-side roller opens, and the printing paper can be easily replaced.

In addition, when the cover is locked in the closed position, the urging force of the cover urging member is not applied to the cover side. The force used to lock the cover can therefore be easily set.

Further preferably, the cover-side roller is supported by a roller support lever, and the roller support lever is attached to the cover so that the roller support lever can move relative to the chassis-side roller.

By thus rendering a roller support lever the position of the cover and the position of the transportation roller pair can be determined as desired. In addition, when the cover is closed, the urging force of the cover urging member can push the cover-side roller movably to the chassis-side roller.

Further preferably in this aspect of the invention a roller support lever that supports the cover-side roller is disposed to the cover so that the roller support lever can pivot on an axis of rotation that is parallel to the pivot axis on which the cover opens and closes, the roller support lever is arranged to rotate to a retracted position stacked to the cover when the cover is opened, and to rotate to a protruding position protruding in the direction pushing the cover-side roller to the chassis-side roller when the cover is closed. With this configuration the roller support lever will not protrude and interfere with maintenance or replacing the roll paper when the cover is opened.

In a printer according to a preferred aspect of the invention the cover can be used as the cover to a roll paper compartment. In this configuration the cover pivots on a pivot shaft at the bottom end thereof between an upright closed position and a substantially horizontal open position, and opens and closes the roll paper compartment.

In another aspect of the invention the chassis-side roller is disposed to a position opposite the position of the cover when the cover is closed with the roll paper compartment in the printer chassis therebetween, and printing paper delivered from roll paper stored in the roll paper compartment is conveyed between the chassis-side roller and the cover-side roller to an exit rendered on the cover side.

Yet further preferably, a roller support lever is movably disposed to a lever support unit disposed to the platen, and the cover-side roller is supported by the roller support lever.

Yet further preferably, a platen is attached to the cover so that when the cover is closed the platen is positioned above the roll paper compartment.

Yet further preferably, the lever support unit is an elliptical hole that enables the roller support lever to rotate and move, and a support shaft is attached to the roller support lever inserted in said hole so that the support shaft can rotate and move. In this case the cover urging member is attached between the printer chassis and the support shaft. A tension spring may be used as the cover urging member.

Further preferably, the printer also has a lever urging member that urges the roller support lever to the cover side, and a lever guide unit formed in the printer chassis. When the cover is opened, the roller support lever moves by the urging force of the lever urging member to a retracted position stacked with the cover, and when the cover is closed, the roller support lever moves to a protruding position guided by the lever guide unit.

In addition, because the cover unit resists (is pulled) the urging force of the lever urging member when the cover is closed, the lever urging member can buffer the impact when a shock load is applied (such as when the user closes the cover violently) to the roller support lever, and damage to the roller positioning channel, rollers, and other parts can be prevented.

The roller support lever can be moved to the retracted position folded to the cover by a 4-part linkage mechanism for opening and closing the cover.

Further preferably, the roller support lever has a panel portion that intercedes between the roll paper compartment and the cover when the cover is closed.

When roll paper is stored so that it can roll inside the roll paper compartment, the roll paper may roll more than necessary when the operation delivery paper from the stored roll is executed repeatedly. When this happens the printing paper on the outside of the paper roll may loosen and bulge to the outside, and may even rise into the paper transportation path and cause a paper jam. However, by disposing this divider panel to the roller support lever, printing paper slack from the roll paper can be suppressed and prevented from rising into the paper transportation path.

A printer according to at least one embodiment of the invention uses a cover urging member that urges the cover toward the closed position so that the cover does not open suddenly and forcefully to produce pressure between the transportation roller pair. Therefore, the damper or other member for preventing the cover from opening forcefully and the separate member for applying pressure between the transportation roller pair that are required by the related art can be replaced by a single cover urging member, the number of parts can therefore be reduced, the construction accordingly simplified, and the size and cost can be reduced.

Closing the cover in the related art can be difficult because the cover must be closed in resistance to the spring force urging the transportation roller pair together. The cover can be easily closed with at least one embodiment of at least one embodiment of the invention, however, because the force pushing the transportation roller pair together is produced by the cover urging member.

When the cover is closed the urging force of the cover urging member works as the force pressing the transportation roller pair together once the transportation rollers make contact. As a result, the urging force of the cover urging member does not work on the cover side when the cover is locked. The force needed to lock the cover can thus be easily set.

Furthermore, because the roller support lever is urged by the cover urging member, shock can be buffered by the cover urging member even when an impact load is applied (such as when the user closes the cover violently), and damage to the roller positioning channel and rollers can be prevented.

Other objects and attainments together with a fuller understanding of at least one embodiment of the invention will become apparent and appreciated by referring to the following description and claims taken in conjunction with the accompanying drawings.

DESCRIPTION OF PREFERRED EMBODIMENTS

A printer according to a preferred embodiment of the invention is described below with reference to the accompanying figures.

General Configuration

Figure 1A:
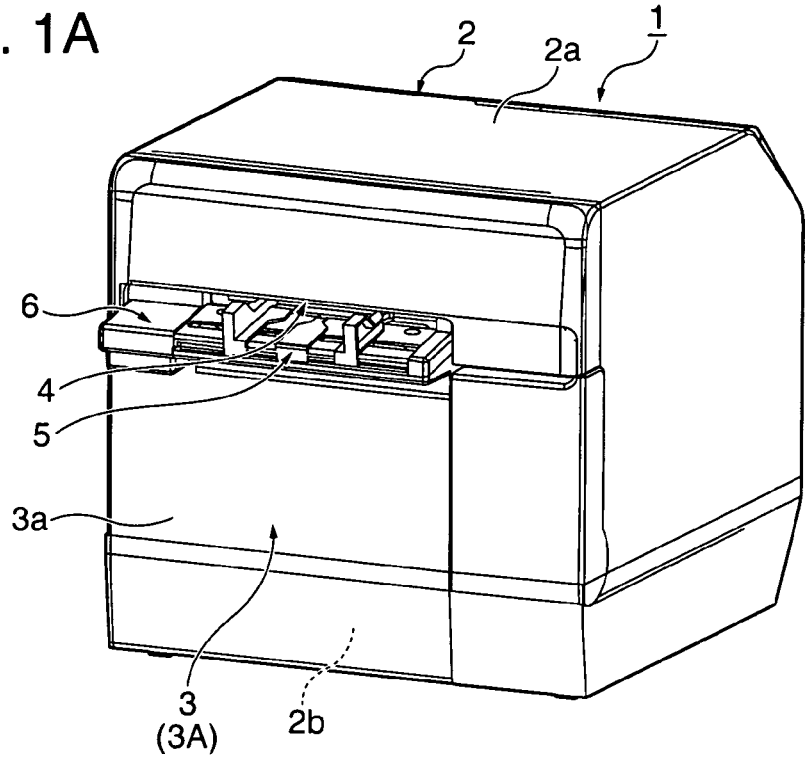
FIG. 1A and FIG. 1B are external oblique views of a printer according to a preferred embodiment of the invention.
Figure 1B:
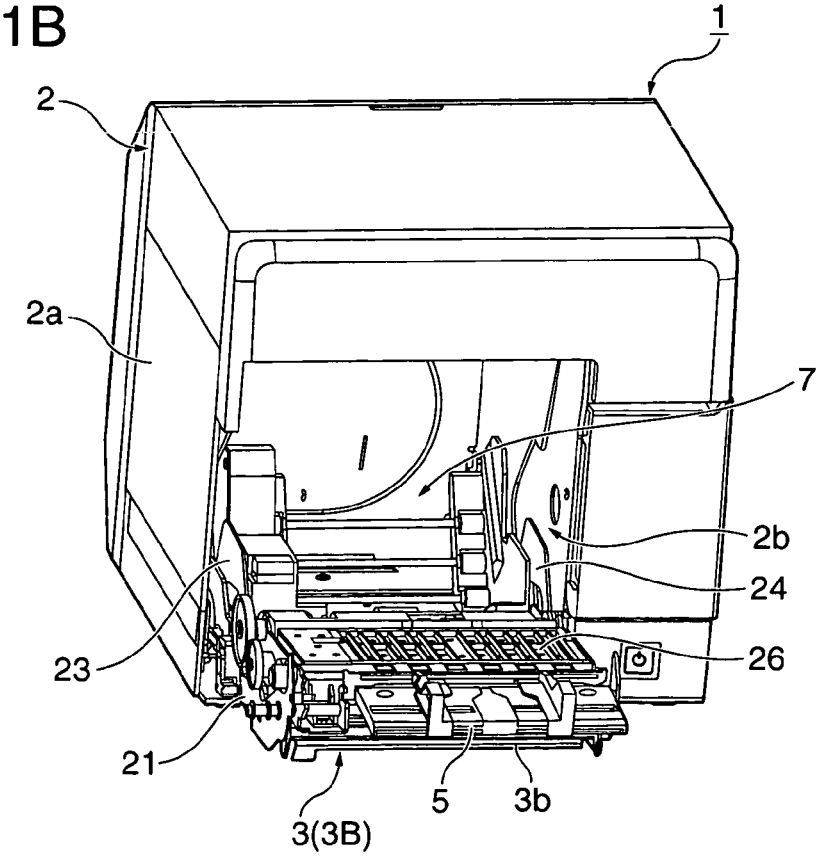

FIG. 1A is an oblique view showing an inkjet roll paper printer according to a first embodiment of the invention. FIG. 1B is an oblique view of the same printer with the cover open.

As shown in the figures, the printer 1 has a rectangular box-like case 2 and a cover unit 3 that opens and closes and is disposed to the front of the case 2. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3*a* of the cover unit 3.

Operating the cover opening lever 6 unlocks the cover unit 3. When the exit guide 5 is pulled forward, the cover unit 3 pivots at the bottom end part thereof and opens forward from the upright closed position 3A shown in FIG. 1A to a substantially horizontal open position 3B shown in FIG. 1B. When the cover unit 3 opens, the roll paper compartment 7 formed inside the printer is open. The platen 26 that defines the printing position also moves with the cover unit 3 at the same time, thus opening the paper transportation path from the roll paper compartment 7 to the paper exit 4 so that the roll paper can be easily replaced from the front of the printer. Note that the cover 3*a* of the cover unit 3 and the cover opening lever 6 are not shown in FIG. 1B.

Printing Mechanism Unit

Figure 2A:
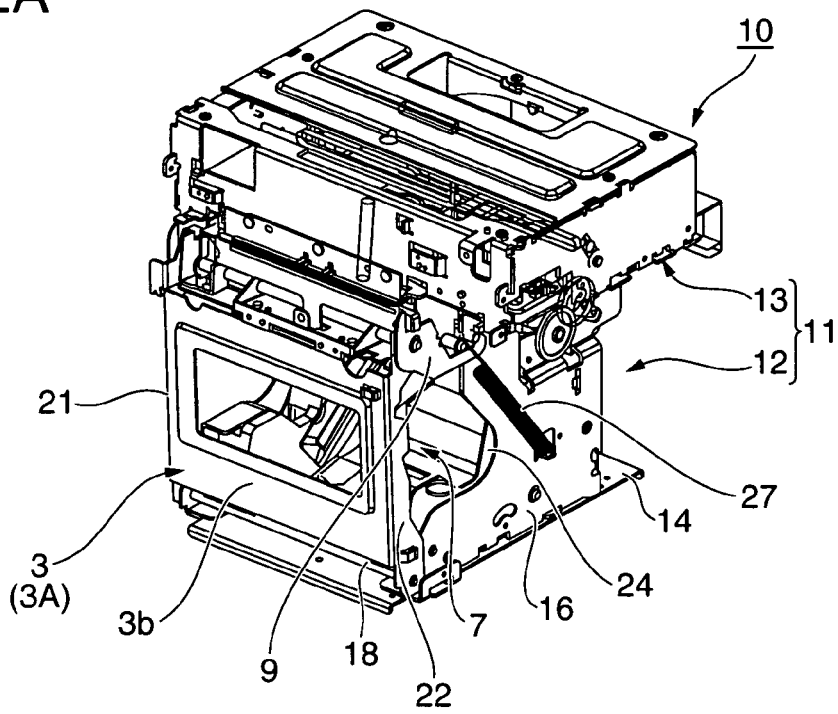
FIG. 2A and FIG. 2B are external oblique views of the printing mechanism unit.
Figure 2B:
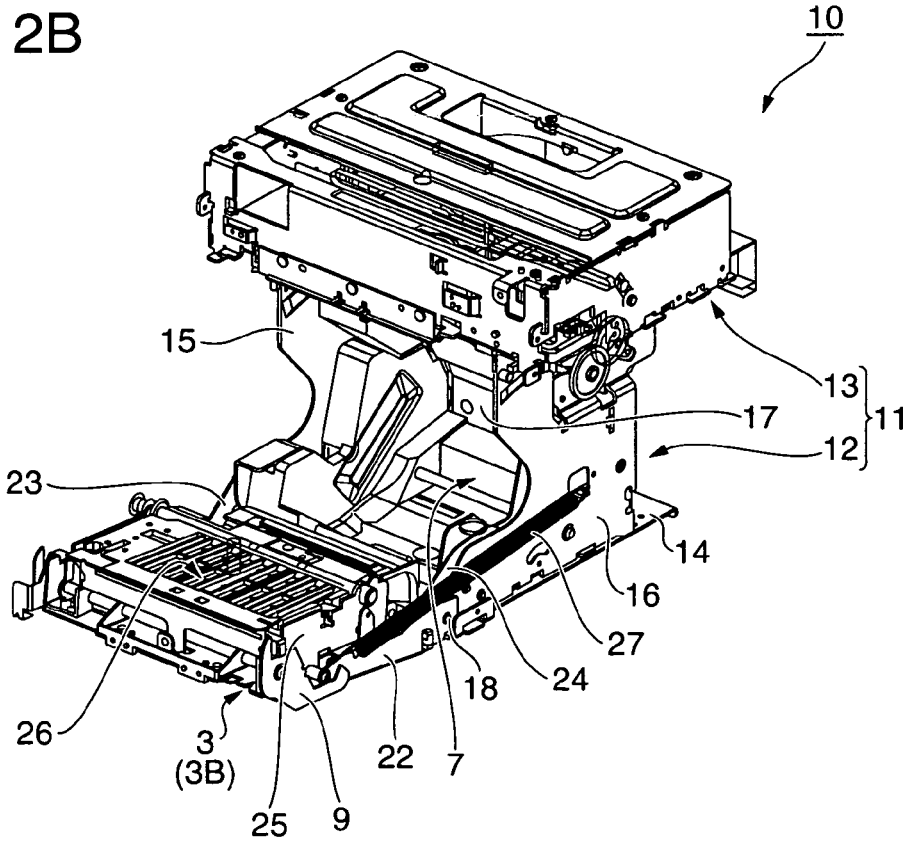

FIG. 2A and FIG. 2B are oblique views of the printing mechanism unit that is covered by the outside case 2*a* and cover 3*a* of the printer 1, FIG. 2A showing the printing mechanism unit when the cover unit 3 is closed and FIG. 2B showing the printing mechanism unit when the cover unit 3 is open.

The printer mechanism unit 10 has a printer frame 11 made of sheet metal to which other parts are disposed. Disposed to the printer frame 11 are a chassis-side frame unit 12 and a head-side frame unit 13 disposed horizontally to the top of the chassis-side frame unit 12.

The chassis-side frame unit 12 has a bottom 14, left and right side panels 15 and 16, and a back panel 17. The roll paper compartment 7 is rendered inside the chassis-side frame unit 12. A support shaft 18 travels horizontally widthwise to the printer at the front bottom ends of the left and right side panels 15 and 16, and the cover unit 3 is supported pivotably on this support shaft 18 as the axis of rotation.

The cover unit 3 has a rectangular cover frame 3*b* made of sheet metal, and this cover frame 3*b* is attached to a 4-part parallel linkage mechanism. This parallel linkage mechanism includes a pair of left and right front parallel links 21 and 22 and a pair of left and right rear parallel links 23 and 23. A rectangular box-like platen frame 25 is disposed horizontally between the tops of the four links 21 to 24. The platen 26 is attached horizontally to the top of the platen frame 25. This 4-part linkage mechanism enables the cover unit 3 to pivot between the closed position 3A shown in FIG. 2A and the open position 3B shown in FIG. 2B while holding the platen 26 substantially level.

A damper spring 27 (cover urging member) rendered by a tension spring is attached between the cover unit 3 that opens and closes and the stationary side panel 16 of the printer frame 11, and urges the cover unit 3 to the closed position. When the locking member 9 that holds the cover unit 3 in the closed position 3A is released so that the cover unit 3 can open, the damper spring 27 prevents the cover unit 3 from dropping forcefully forward and open. The urging force of the damper spring 27 increases as the open angle of the cover unit 3 increases. When the cover unit 3 approaches the fully open position, the cover unit 3 moves quite slowly and is prevented from forcefully hitting the surface on which the printer 1 is positioned.

Figure 3A:
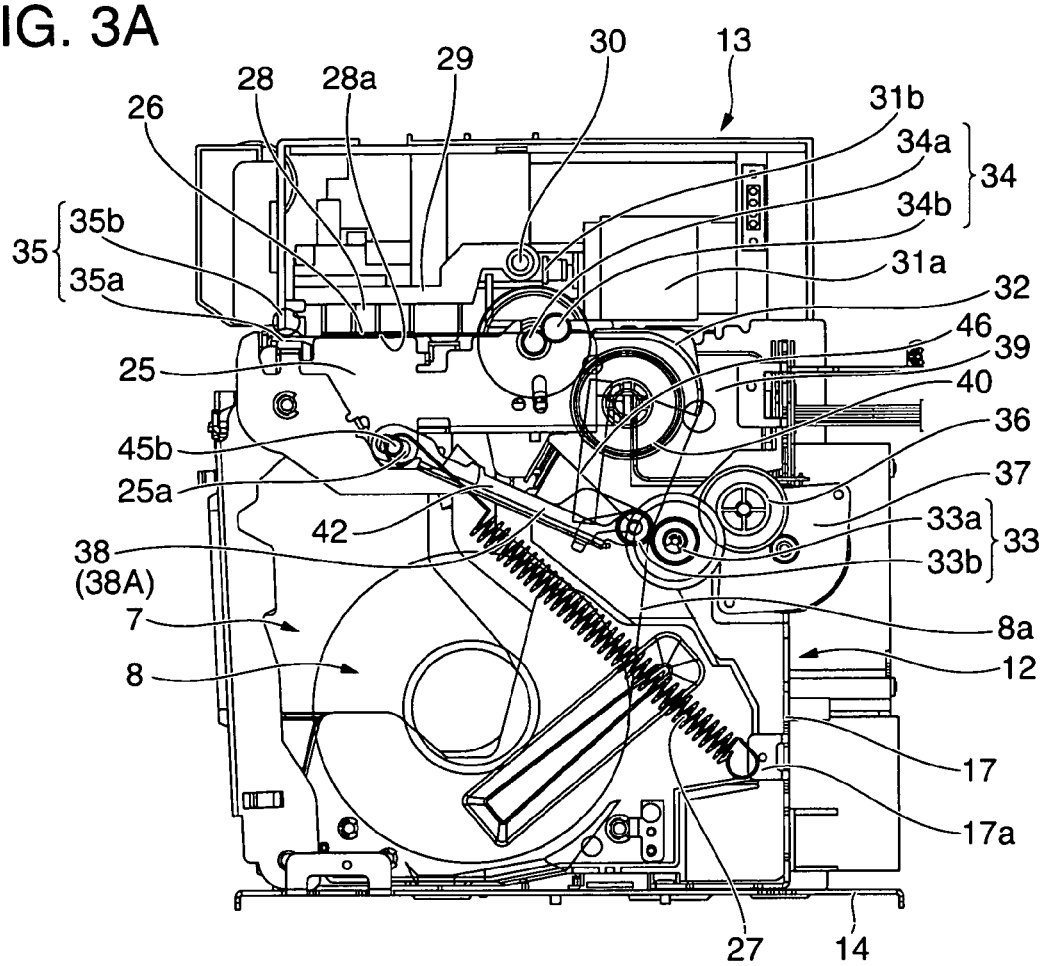
FIG. 3A is a schematic section view showing the inside of the printer.

As further described below, an inkjet head 28, a head carriage 29 on which the inkjet head 28 is carried, and a carriage transportation mechanism are assembled inside the head-side frame unit 13 as shown in FIG. 3A.

Internal Configuration of the Printer

Figure 4A:
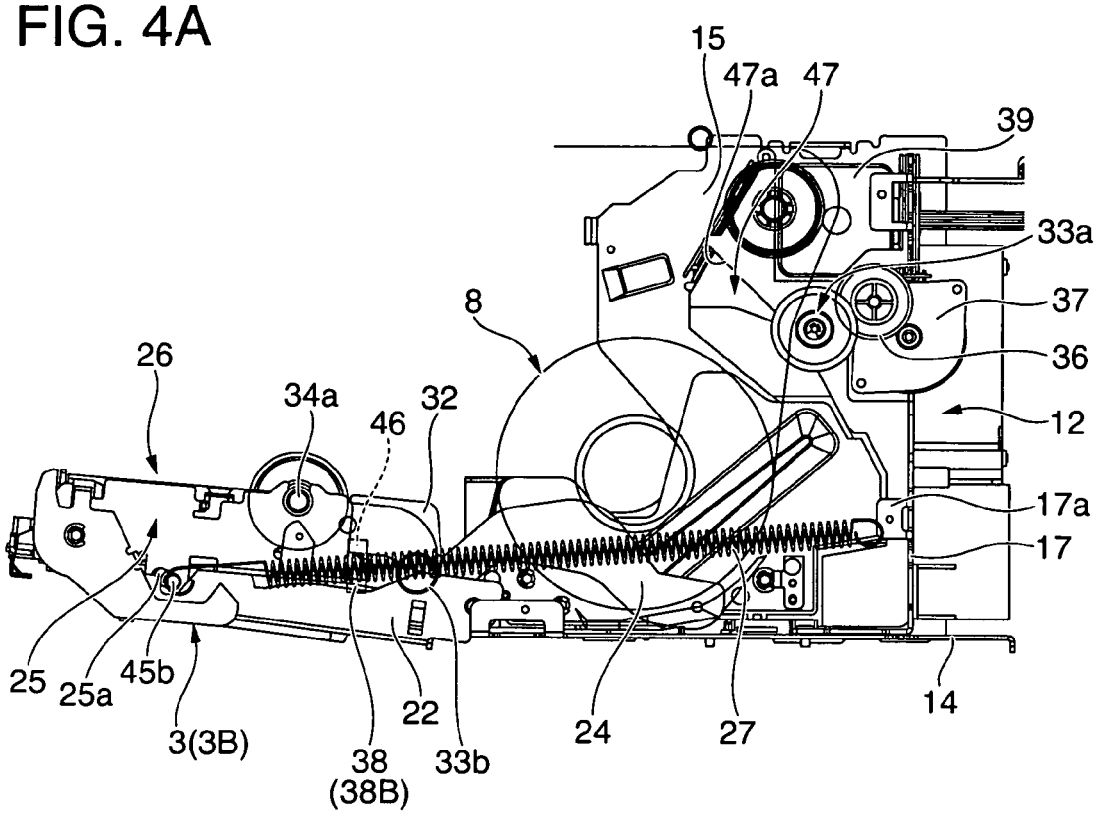
FIG. 4A is a schematic view showing the inside of the printer when the cover is open.

The internal configuration of the printer is described below with reference to FIG. 3A and FIG. 4A, which are schematic side views showing the internal configuration of the printer 1, FIG. 3A showing the cover unit 3 closed and FIG. 4A showing the cover unit 3 open. The roll paper 8 is stored horizontally widthwise to the printer in the roll paper compartment 7 formed inside the printer.

The head-side frame unit 13 is attached horizontally above the roll paper compartment 7. The inkjet head 28, the head carriage 29, and a carriage guide shaft 30 that guides movement of the head carriage 29 widthwise to the printer are disposed to the head-side frame unit 13. The inkjet head 28 is mounted on the head carriage 29 with the nozzle surface 28*a* facing down. A carriage transportation mechanism having a carriage motor 31*a* and a timing belt 31*b* for driving the head carriage 29 bidirectionally along the carriage guide shaft 30 is mounted on the head-side frame unit 13.

The platen 26 is disposed below the nozzle surface 28*a* of the inkjet head 28 with a constant gap therebetween, and defines the printing position of the inkjet head 28. A tension guide 32 that curves downward is disposed on the upstream side of the platen 26 in the transportation direction. The tension guide 32 is urged upward by a spring force, and the printing paper 8*a* delivered from the roll paper 8 stored in the roll paper compartment 7 is conveyed through the paper transportation path passed the printing position with a predetermined tension applied to the paper by the tension guide 32.

Disposed to the paper transportation path are a first transportation roller pair 33 including a first transportation roller 33*a* and a first follower roller 33*b*, a second transportation roller pair 34 including a second transportation roller 34*a* and a second follower roller 34*b*, and a third transportation roller pair 35 including a third transportation roller 35*a* and a third follower roller 35*b*.

The first transportation roller pair 33 is disposed below the tension guide 32 at a position behind the roll paper compartment 7. The first transportation roller 33*a* is disposed horizontally widthwise to the printer between the left and right side panels 15 and 16 of the printer frame 11. Torque from a transportation motor 37 is transferred through a speed-reducing gear train 36 to the first transportation roller 33*a*. The first follower roller 33*b* is supported freely rotatably at the distal end part (the end part at the back of the printer) of a roller support lever 38 that is attached to the platen frame 25 on the cover unit 3 side. When the cover unit 3 is closed, the force of the damper spring 27 pushes the first follower roller 33*b* against the first transportation roller 33*a* with the printing paper 8*a* therebetween.

The second transportation roller pair 34 is disposed at a position on the upstream side of the platen 26 in the transportation direction. The second transportation roller 34*a* is attached to the platen frame 25 on the cover unit 3 side, and the second follower roller 34*b* is disposed on the head-side frame unit 13 side. When the cover unit 3 is closed, the second follower roller 34*b* is pressed with a predetermined force against the second transportation roller 34*a* with the printing paper 8*a* therebetween. Torque from the transportation motor 37 affixed to the chassis-side frame unit 12 is transferred through a speed-reducing gear train 40 to the second transportation roller 34*a*.

The third transportation roller pair 35 is disposed at a position downstream from the platen 26 in the transportation direction. The third transportation roller 35*a* is disposed to the platen frame 25 on the cover unit 3 side, and the third follower roller 35*b* is disposed on the head-side frame unit 13 side. The third transportation roller 35*a* is connected to the second transportation roller 34*a* through a gear train not shown, and thus rotates in synchronization with the second transportation roller 34*a*. When the cover unit 3 is closed, the third follower roller 35*b* is pressed to the third transportation roller 35*a* with the printing paper 8*a* therebetween.

The printing paper 8*a* delivered from the roll paper 8 is conveyed through the first transportation roller pair 33, the tension guide 32, and the second transportation roller pair 34 over the surface of the platen 26, and through the third transportation roller pair 35 and the paper transportation path to the paper exit 4. The inkjet head 28 prints on the surface of the printing paper 8*a* as the paper travels over the printing position at the platen 26. After the inkjet head 28 prints across the width of the printing paper 8*a* while being driven by the carriage transportation mechanism, the first to third transportation roller pairs 33 to 35 are driven rotationally to advance the printing paper 8*a* a predetermined pitch. The next line is then printed. The printing paper 8*a* is thus printed by the inkjet head 28 as the printing paper 8*a* is conveyed intermittently a predetermined pitch. A paper cutting mechanism such as a scissor-type cutting mechanism (not shown in the figure) is disposed to the paper exit 4 from which the printing paper 8*a* is discharged after printing. The paper cutting mechanism cuts across the width of the printing paper 8*a* positioned between the blades.

Support Mechanism for the Follower Roller 33*b*

Figure 3B:
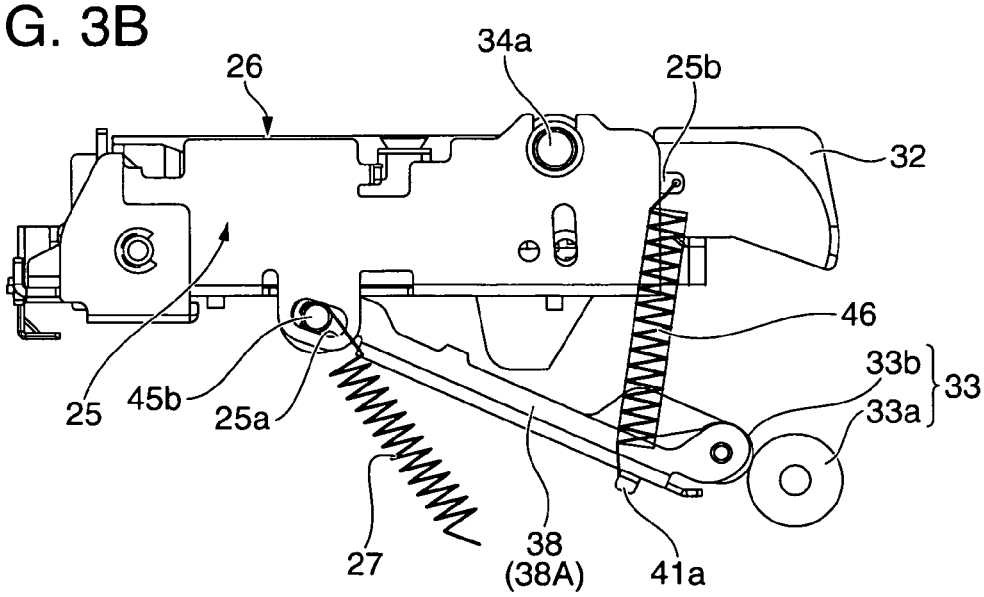
FIG. 3B is a schematic view of the roller support lever.
Figure 4B:
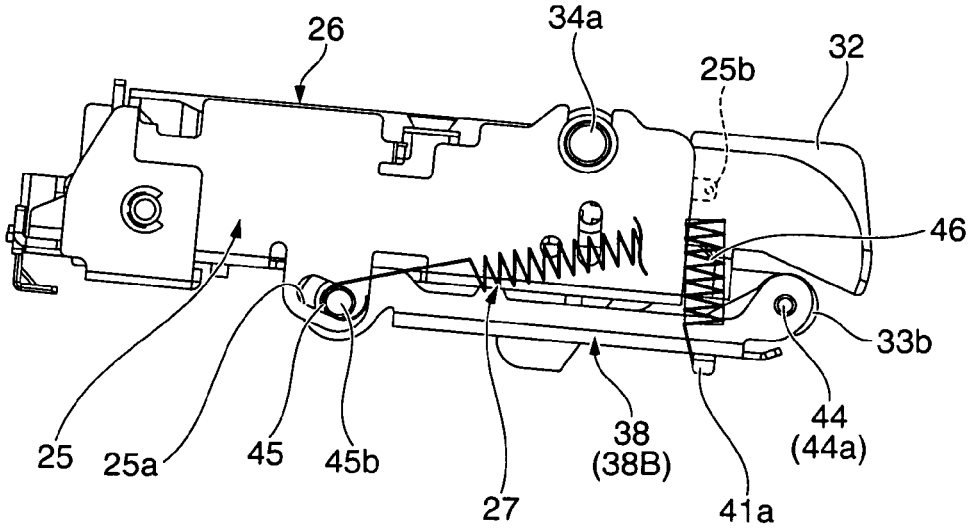
FIG. 4B is a schematic view of the roller support lever when the printer cover is open.
Figure 5A:
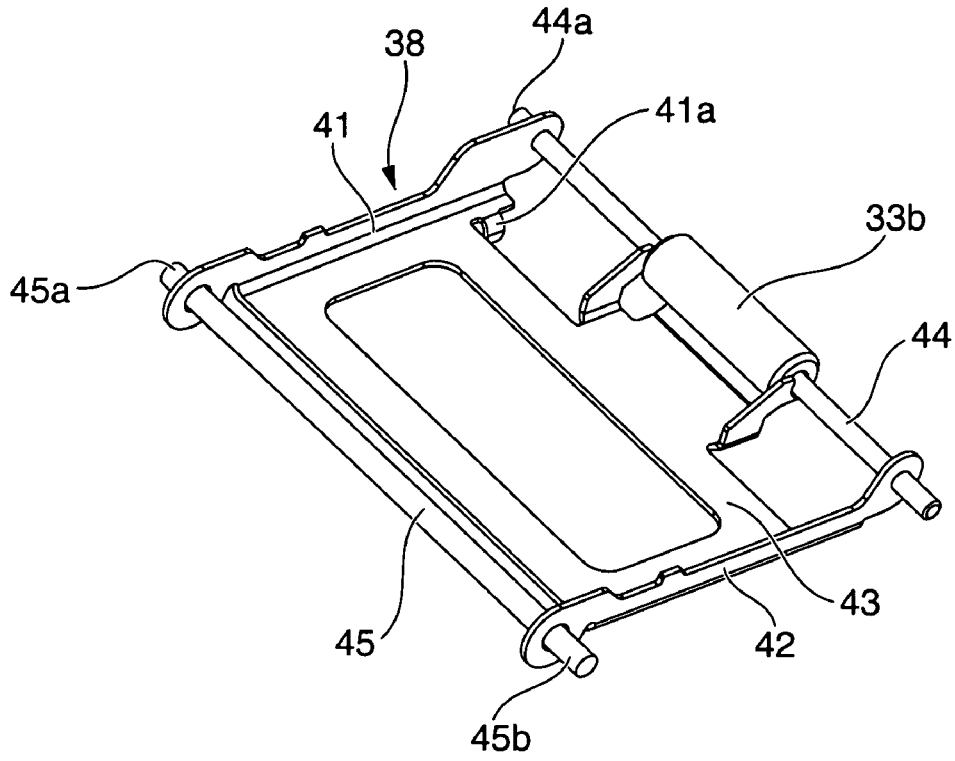
FIG. 5A is an oblique view of the roller support lever.
Figure 5B:
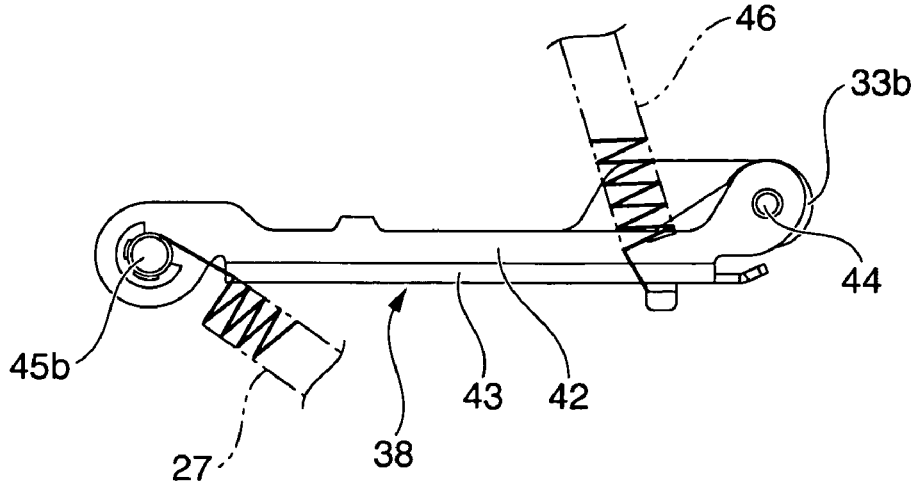
FIG. 5B is a side view of the roller support lever.

FIG. 3B and FIG. 4B describe the support mechanism for the first follower roller 33*b* of the first transportation roller pair 33, FIG. 3B showing the arrangement when the cover unit 3 is closed and FIG. 4B showing the arrangement when the cover unit 3 is open. FIG. 5A and FIG. 5B are an oblique view and a side view, respectively, of the first follower roller 33*b* and the roller support lever 38.

As shown in FIG. 5A, the roller support lever 38 has left and right frame plates 41 and 42, and a rectangular frame-shaped connecting panel 43 connecting the frame plates 41 and 42. A roller shaft 44 spans horizontally widthwise to the printer between the distal end parts of the left and right frame plates 41 and 42, and the first follower roller 33*b* is supported freely rotatably on the roller shaft 44. A support shaft 45 spans horizontally widthwise to the printer at the base end parts of the left and right frame plates 41 and 42.

Both axial end parts of the support shaft 45 are inserted to left and right holes 25*a* formed in the bottom end parts of the left and right side wall parts of the platen frame 25. As shown in FIG. 3B, these holes 25*a* are elliptical holes formed with the long axis pointing towards the first transportation roller 33*a*, and the axial end parts 44*a* and 45*b* of the support shaft 45 are inserted so that they can slide and rotate freely inside the holes 25*a*. The roller support lever 38 is thus attached to the platen frame 25 on the cover unit 3 side so that the roller support lever 38 can rotate freely on the support shaft 45 (axis of rotation) and can slide a predetermined stroke along the long axis of the holes 25*a* to and away from the first transportation roller 33*a*.

One end of the damper spring 27 is attached to one axial end part 45*b* of the support shaft 45. The other end of the damper spring 27 is connected to a spring catch 17*a* formed at a position near the bottom of the back panel 17 of the printer frame 11 at the back side of the roll paper compartment 7. This causes the tension of the damper spring 27 to act through the support shaft 45 on the first follower roller 33*b* at the distal end of the roller support lever 38. While the support shaft 45 moves inside the holes 25*a*, the first follower roller 33*b* is pressed by the urging force of the damper spring 27 toward the first transportation roller 33*a*.

A spring catch 41*a* is also formed at a position on the distal end side of the frame plate 41 of the roller support lever 38, and a spring catch 25*b* is formed on the platen frame 25 at a position on the back side of the printer. A lever lift spring 46 (lever urging member) is connected in tension between these spring catches 41*a* and 25*b*. When external restraint is removed such as when the cover unit 3 opens and the urging force of the damper spring 27 ceases to work, the roller support lever 38 is held by the tension of this lever lift spring 46 raised to the bottom side of the platen frame 25 in the retracted position 38B shown in FIG. 4B.

As shown in FIG. 4A, a lever guide slot 47 is formed on the inside of the side panel 15 of the chassis-side frame unit 12 facing the roll paper compartment 7. This lever guide slot 47 is a substantially triangular slot that narrows toward the back of the printer, and the lever guide slot 47 opens toward the center of the first transportation roller 33*a*. When the cover unit 3 closes from the open position 3B, the axial end part 44*a* (see FIG. 4B) of the roller shaft 44 of the roller support lever 38 enters the lever guide slot 47 and contacts the top guide edge 47*a* (lever guide unit) before the cover unit 3 reaches the closed position 3A. As the cover unit 3 continues to close, the axial end part 44*a* of the roller shaft 44 is guided downward by the guide edge 47*a*. This lever guide slot 47 causes the roller support lever 38 lifted upward by the lever lift spring 46 to rotate down and move from the platen frame 25 down and toward the back of the printer to a protruding position 38A.

As a result, when the cover unit 3 is closed, the first follower roller 33*b* moves toward the first transportation roller 33*a* as shown in FIG. 3B, and is pressed to the first transportation roller 33*a* by the urging force of the damper spring 27.

Operation of the Roller Support Lever in Conjunction with Opening and Closing the Cover The opening and closing operation of the cover unit 3 is described next with reference to FIG. 6A, FIG. 6B, FIG. 6C, and FIG. 6D. The movement of the roller support lever 38 as the cover unit 3 opens and closes is described with reference to these figures.

Figure 6A:
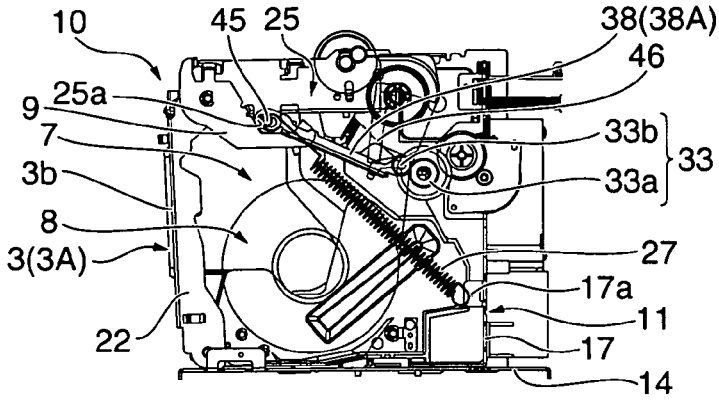
FIG. 6A, FIG. 6B, FIG. 6C, and FIG. 6D describe the operation of the roller support lever when the cover opens and closes.

When the cover unit 3 is in the closed position 3A as shown in FIG. 6A, the roller support lever 38 is urged toward the back of the printer by the tension of the damper spring 27 and the first follower roller 33*b* disposed to the end of the roller support lever 38 is pressed from the front to the first transportation roller 33*a* on the printer frame 11 side. When the locking member 9 engages the cover unit 3, the urging force of the damper spring 27 on the cover unit 3 is not needed, and the urging force of the damper spring 27 therefore does not work on the cover unit 3. The force used to lock the cover unit 3 can therefore be easily set.

When the cover unit 3 is in the closed position 3A, the first follower roller 33*b* supported on the distal end of the support shaft 45 of the roller support lever 38 is urged by the damper spring 27 to slide a predetermined stroke to and away from the first transportation roller 33*a* along the long axis of the holes 25*a* in the platen frame 25 (the direction from the center of the first follower roller 33*b* to the center of the first transportation roller 33*a*).

The support shaft 45 does not move in the direction in which the cover unit 3 pivots, and the urging force of the damper spring 27 on the cover unit 3 is released. Because the first follower roller 33*b* can move while urged by the damper spring 27, the first follower roller 33*b* can be pressed with a predetermined urging force against the first transportation roller 33*a* with the printing paper 8*a* therebetween, thereby achieving a stable transportation force.

Figure 6B:
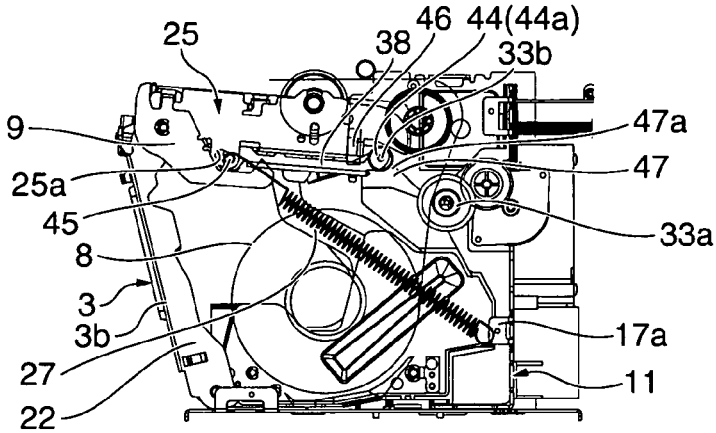

When the cover unit 3 is unlocked by the locking member 9 and the cover unit 3 is opened forward from the closed position 3A, the cover unit 3 attempting to open forward is again urged by the tension of the damper spring 27 in the closing direction as shown in FIG. 6B. As the cover unit 3 then moves from the position in FIG. 6B to the fully open position 3B as shown in FIG. 6C and FIG. 6D, the force of the damper spring 27 increases and prevents the cover unit 3 from dropping quickly and forcefully forward and open.

The damper spring 27 thus functions primarily as an urging member that produces pressure pushing the first follower roller 33*b* to the first transportation roller 33*a* when the cover unit 3 is closed, and functions primarily as a damping member when the cover unit 3 opens to prevent the cover unit 3 from opening quickly and forcefully. Because a single damper spring 27 serves two functions, the construction is simplified and both size and cost can be reduced compared with a configuration using a plurality of parts to achieve the same function.

Figure 6C:
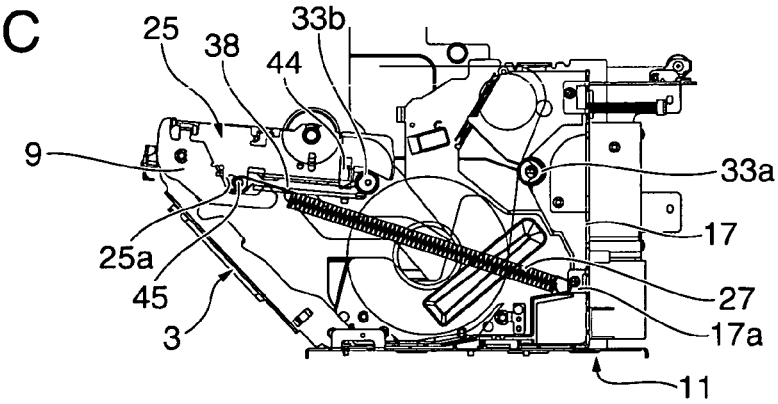

When the cover unit 3 starts opening, the first follower roller 33*b* separates from the first transportation roller 33*a* as shown in FIG. 6B and FIG. 6C, and the urging force of the damper spring 27 stops working on the roller support lever 38. As the cover unit 3 continues opening, the axial end part 44*a* of the roller shaft 44 of the roller support lever 38 leaves the lever guide slot 47, and the roller support lever 38 is raised by the lever lift spring 46 toward the platen frame 25 and held against the cover unit 3 (in the retracted position 38B). The platen frame 25 moves forward with the cover unit 3 while held substantially level by the 4-part linkage mechanism.

Figure 6D:
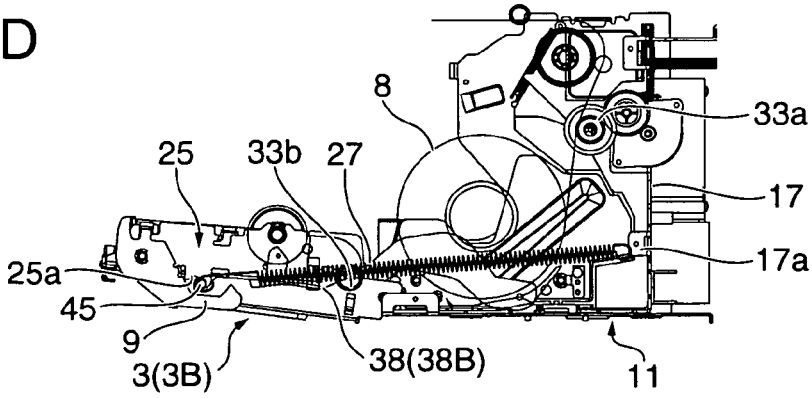

The cover unit 3 is shown in the fully open position 3B in FIG. 6D and FIG. 4B. At this time the platen frame 25 is stacked with the cover unit 3, and the roller support lever 38 is positioned between the platen frame 25 and the cover unit 3 (retracted position 38B). The roller support lever 38 therefore cannot interfere with replacing the roll paper 8.

Closing the cover unit 3 from the open position 3B is described next.

When the cover unit 3 is closed from the open position 3B as shown in FIG. 6D and FIG. 4B, the cover unit 3 moves back through the positions shown in FIG. 6C and FIG. 6B, and the axial end part 44*a* of the roller shaft 44 of the roller support lever 38 contacts the guide edge 47*a* of the lever guide slot 47. As the cover unit 3 continues closing guided by the guide edge 47*a*, the roller support lever 38 rotates and moves down in resistance to the urging force of the lever lift spring 46, and the first follower roller 33*b* supported on the distal end thereof is guided toward the first transportation roller 33*a*. As a result, when the cover unit 3 closes, the roller support lever 38 returns to the protruding position 38A as shown in FIG. 6A and FIG. 3B, the urging force of the damper spring 27 works, and the first follower roller 33*b* is pressed against the first transportation roller 33*a*. At this time, the urging force of the damper spring 27 does not work on the cover unit 3.

As described above, the roller support lever 38 is disposed so that it can rotate and move on the platen frame 25 that opens and closes with the cover unit 3, and the first follower roller 33*b* is disposed to the distal end of the roller support lever 38, in a printer 1 according to this embodiment of the invention. A damper spring 27 that buffers impact of the cover unit 3 when the cover unit 3 opens is also disposed to the roller support lever 38. The damper spring 27 exerts pressure pushing the first follower roller 33*b* against the first transportation roller 33*a* with the printing paper 8*a* therebetween when the cover unit 3 is closed.

An urging member that applies pressure to the first transportation roller pair 33 and a separate damping member that buffers the impact of the cover unit 3 when opening are therefore not needed. The number of parts can therefore be reduced, the construction accordingly simplified, and the size and cost can be reduced.

The first follower roller 33*b* is attached to the roller support lever 38. The layout and freedom of design, including the position of the first transportation roller pair, is improved because the roller support lever 38 can be adapted to the location of the first transportation roller pair 33 by using a roller support lever 38 of a length and position corresponding to the location of the first transportation roller 33*a*.

When the cover unit 3 opens, the roller support lever 38 moves from the protruding position 38A to the retracted position 38B stacked with the platen frame 25 and folded to the cover unit 3. As a result, the roller support lever 38 does not interfere with replacing the roll paper, for example, when the cover unit 3 is open.

When the cover unit 3 is closed, the roller support lever 38 is guided by the lever guide slot 47 and the first follower roller 33*b* attached to the distal end of the roller support lever 38 can be reliably positioned to the stationary-side first transportation roller 33*a*. The first follower roller 33*b* can therefore be pressed with predetermined force against the first transportation roller 33*a* with the printing paper 8*a* therebetween.

In addition, a rectangular frame-like connecting panel 43 that separates the roll paper compartment 7 and platen frame 25 is disposed to the roller support lever 38. When the printing paper 8*a* is pulled from the roll paper 8, which is stored so that it can roll inside the roll paper compartment 7, inertia may cause the roll paper 8 to roll more than necessary. When this happens the printing paper 8*a* on the outside of the roll paper 8 may loosen and bulge to the outside, and may even rise into the paper transportation path and cause a paper jam. However, by disposing this connecting panel 43 to the roller support lever 38, printing paper 8*a* slack from the roll paper 8 can be suppressed and prevented from rising into the paper transportation path.

Closing the cover in the related art can be difficult because the cover must be closed in resistance to the spring force urging the transportation roller pair together. The cover unit 3 can be easily closed with at least one embodiment of the invention, however, because the damper spring 27 also changes an urging force in the direction closing the cover unit 3.

In addition, when the cover unit 3 is closed and the first transportation roller pair 33 make contact, the urging force of the damper spring 27 changes from a force closing the cover unit 3 to pressure on the first transportation roller pair 33. As a result, when the cover unit 3 is locked in the closed position, the urging force of the damper spring 27 does not work on the cover unit 3 side or is a weak force. The force required to lock the cover unit 3 can therefore be easily set.

In addition, because the roller support lever 38 resists (is pulled) the urging force of the lever lift spring 46 when the cover unit 3 is closed, the lever lift spring 46 can buffer the impact when a shock load is applied (such as when the user closes the cover violently), and damage to the holes 25*a*, rollers 33*a* and 33*b*, and other parts can be prevented.

At least one embodiment of the invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a cover attached to a printer chassis so that it can be opened and closed;

a transportation roller pair that conveys printing paper that includes a chassis-side roller that is attached to the printer chassis and a cover-side roller that is attached to the cover and is arranged to separate from the chassis-side roller when the cover is opened;

a cover urging member that is attached between the cover and the printer chassis and that urges the cover in the closing direction when the cover is opened;

a roller shaft that supports the cover-side roller rotatably;

a roller support lever that supports the roller shaft; and a support shaft that is attached to the cover and that supports the roller support lever rotatably;

wherein the roller support lever is urged toward the printer chassis by a tension of the cover urging member, and urges the cover-side roller to the chassis-side roller in a direction so as to be pushed together when the cover is closed.

2. The printer described in claim 1, wherein the roller support lever rotates on the support shaft to a retracted position stacked to the cover when the cover is opened, and rotates to a protruding position protruding in the direction pushing the cover-side roller to the chassis-side roller when the cover is closed.

3. A printer comprising:

a cover attached to a printer chassis so that it can be opened and closed;

a roll paper compartment that accommodates printing paper wound to a roll;

a transportation roller pair that conveys printing paper that includes a chassis-side roller that is attached to the printer chassis and a cover-side roller that is attached to the cover and is arranged to separate from the chassis-side roller when the cover is opened;

a cover urging member that is attached between the cover and the printer chassis and that urges the cover in the closing direction when the cover is opened;

a roller shaft that supports the cover-side roller rotatably;

a roller support lever that supports the roller shaft; and a support shaft that is attached to the cover and that supports the roller support lever rotatably;

wherein the roller support lever is urged toward the printer chassis by a tension of the cover urging member, and urges the cover-side roller to the chassis-side roller in a direction so as to be pushed together when the cover is closed, and the cover is arranged to pivot on a pivot shaft at the bottom end thereof between an upright closed position and a substantially horizontal open position, and to open and close the roll paper compartment.

4. The printer described in claim 3, wherein:

the chassis-side roller is disposed to a position opposite a position of the cover when the cover is closed with the roll paper compartment in the printer chassis therebetween; and the printing paper delivered from the roll stored in the roll paper compartment is conveyed between the chassis-side roller and the cover-side roller to an exit rendered on the cover side.

5. The printer described in claim 3, further comprising:

a lever support unit arranged on the cover that is formed as an elliptical hole;

wherein the support shaft is inserted in the elliptical hole so that the support shaft can rotate and slide; and the cover urging member is attached between the printer chassis and the support shaft.

6. The printer described in claim 5, further comprising:

a lever urging member disposed to the lever support unit that urges the roller support lever to the lever support unit side; and a lever guide unit formed in the printer chassis;

wherein when the cover is opened, the roller support lever moves by the urging force of the lever urging member to a retracted position stacked with the cover, and when the cover is closed, the roller support lever moves to a protruding position guided by the lever guide unit.

7. The printer described in claim 3, wherein:

the roller support lever comprises a panel portion that intercedes between the roll paper compartment and the cover when the cover is closed.

* * * * *